US005871226A

United States Patent [19]

Klubitschko et al.

[11] Patent Number: 5,871,226

[45] Date of Patent: Feb. 16, 1999

[54] BINDING FOR SNOWBOARDS AND THE LIKE

[75] Inventors: Gerd Klubitschko, Oberammergau; Premek Stepanek, Garmisch-Partenkirchen, both of Germany

[73] Assignee: Marker Deutschland GmbH, Eschenlohe, Germany

[21] Appl. No.: 725,608

[22] Filed: Oct. 3, 1996

[30] Foreign Application Priority Data

Nov. 30, 1995 [DE] Germany ..... 195 44 696.8

[51] Int. Cl.[6] ..... A63C 9/20

[52] U.S. Cl. ..... 280/624; 280/617; 280/14.2

[58] Field of Search ..... 280/618, 623, 280/624, 625, 617, 607, 626, 14.2

[56] References Cited

U.S. PATENT DOCUMENTS

| | | | |
|---|---|---|---|
| 4,097,062 | 6/1978 | Salomon . | |
| 4,973,073 | 11/1990 | Raines et al. . | |
| 5,299,823 | 4/1994 | Glaser . | |
| 5,520,406 | 5/1996 | Anderson et al. | 280/624 |
| 5,690,351 | 11/1997 | Karol | 280/624 X |
| 5,713,594 | 2/1998 | Jenni | 280/14.2 X |
| 5,722,680 | 3/1998 | Dodge | 280/14.2 X |

FOREIGN PATENT DOCUMENTS

| | | | |
|---|---|---|---|
| 0 291 428 | 5/1988 | European Pat. Off. | A63C 9/00 |
| 88 16 097.1 U1 | of 0000 | Germany . | |
| 94 21 276 U1 | of 0000 | Germany . | |

*Primary Examiner*—J. J. Swann
*Assistant Examiner*—Michael Mar
*Attorney, Agent, or Firm*—D. Peter Hochberg

[57] ABSTRACT

A binding having a manually actuable locking member for preventing a sole-retainer from returning to an open or "release" position once the sole-retaining means has advanced towards a fully closed or "clamped-in" position by a predetermnined amount. The position of the sole-retainer is automatically readjusted as soon as any layer of snow, ice or the like on the underside of the boot sole melts.

14 Claims, 6 Drawing Sheets

BINDING FOR SNOWBOARDS AND THE LIKE

FIELD OF THE INVENTION

The present invention relates generally to a binding for snowboards and the like. More particularly, the present invention relates to a binding for snowboards and the like having at least one movable sole-retaining means which, in the event of a boot being introduced into the binding, can be pressed down, by means of the sole of the boot, from a self-holding release position in which the binding is releasably locked in an open position, into a clamped-in position in which the sole is releasably secured in the binding. The binding has a switch member which can be actuated voluntarily and is coupled to the sole-retaining means.

BACKGROUND OF THE INVENTION

In the case of some prior art ski bindings, a movable sole-retaining means is arranged to be disengageable. In this respect, when a predetermined disengagement resistance is exceeded, the sole-retaining means can be moved, by the boot sole, into a release position. As a result, the boot is released from the binding, such as in the event of the skier falling.

The sole is secured in the clamped-in position of the sole-retaining means with a certain degree of elasticity in prior ski bindings. Accordingly, even when the sole-retaining means is at a more or less large distance from its normal clamped-in end position (i.e., fully closed position) the sole-retaining means still acts with sufficient retaining force. This ensures that the sole can be secured with elastic compliance and that the sole can also be secured when there is a layer of snow or ice adhering beneath the sole in the event of a boot being introduced into the binding. When the layer of snow and ice subsequently melts, the movable sole-retaining means is automatically adjusted correspondingly in the direction of its clamped-in end position. Accordingly, the sole is generally retained in a manner in which it can move while still releasably locking the ski boot to the ski.

Although bindings for snowboards or the like may be of a largely similar design to ski bindings, it is preferred in most cases that snowboard bindings cannot be disengaged or put into the release condition during use of the snowboard. In this regard, where snowboards are concerned, the disengagement of a binding in the event of a fall can result in virtually no reduction in the risk of injury. Moreover, there is an undesirable high risk of erroneous disengagement, on account of the forces which act during snowboarding.

SUMMARY OF THE INVENTION

The present invention is based on the general idea of ensuring that a boot sole is clamped in and secured against disengagement or release from the binding on a ski board even when it is in an intermediate closed position (i.e., spaced apart from a fully closed position by a relatively large distance). More specifically, the boot sole is secured against disengagement irrespective of the magnitude of the spring forces which move the movable sole-retaining means into the above-mentioned fully closed position. Consequently, a large depth of snow on the binding can be accommodated, and depending on the magnitude of the above-mentioned spring forces, it is possible to permit a more or less large degree of elasticity of the sole-retaining means and/or a comparatively low actuating resistance of a switch member for disengaging or releasing the binding. Since the magnitude of the spring forces has nothing to do with the avoidance of disengagement of the binding, similar designs and similar springs can be used for the spring mechanism as in the case of disengageable ski bindings.

According to a particularly preferred embodiment of the present invention, a locking member may interact with a switch member or may be arranged on the switch member. The switch member moves the sole-retaining means between the open or release position and the closed or clamped-in position. The locking member may readily be designed such that it can be actuated together with the switch member or if desired, manually actuated.

According to a preferred embodiment of the present invention, the switch member may take the form of a lever. The lever is arranged on a pivot bearing by means of a pivot pin, which is approximately parallel to the upper side of the snowboard or the like. The pivot bearing is movable in a direction which is parallel to the upper side of the snowboard, and runs transversely with respect to the pivot pin. Moreover, the lever is also articulated by way of a joint, which is at a distance from the pivot pin. The sole-retaining means is arranged on a stationary bearing by means of a bearing pin which is at a distance from the joint. The pivot bearing is moved by means of the spring mechanism, under stress in a direction such that, at least in the open or "release" position of the sole-retaining means, the joint pin assumes an over-dead-center position. The lever may readily be designed such that, in the closed or "clamped-in" position of the sole-retaining means, it assumes a position in which it is near to the upper side of the snowboard.

According to a preferred embodiment of the present invention, there is provided a binding having a spring mechanism exerting a predetermined force for moving a sole-retaining means in the direction of a fully closed position (i.e., "clamped-in end position"), when the sole-retaining means is spaced apart from the fully closed position by a distance corresponding to a predetermined snow depth or spanning height (i.e., an intermediate closed position). A locking member prevents the sole-retaining means from returning to an open position (i.e., "release position"). In this regard, the locking member drops into, or can be moved into its locked or engaged position when the sole-retaining means reaches a closed position. This locked position is preferably visually observable. Moreover, the locking member is voluntarily movable to its unlocked or disengaged position.

It is an object of the present invention to provide an improved binding which is suitable for snowboards and the like.

It is another object of the present invention to provide a binding which allows for easy entry of a boot into the binding even if there is a relatively thick layer of snow or ice on the underside of the sole and which also ensures that the boot is secured to the binding in all circumstances.

A further object of the present invention is to provide a binding for snowboards having a sole-retaining device with an open position and a closed position, the closed position having an intermediate closed position near a fully closed position, and a biasing device for biasing the sole-retaining device from the intermediate closed position to the fully closed position.

Yet another object of the present invention is the provision of a binding for snowboards as described above having a locking mechanism for locking the binding in the closed position when the binding assumes the closed position.

Still another object of the present invention is the provision of a locking device as described above which is manually movable between locked and unlocked positions.

It is an additional object of the present invention to provide a locking device as described above, wherein the position of the locking device is visually observable.

A general object of the present invention is to provide an improved binding for snowboards and the like which is effective and efficient to practice.

These and other objects will become apparent from the following description of a preferred embodiment, taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF THE PREFERRED EMBODIMENT

Figure 1:
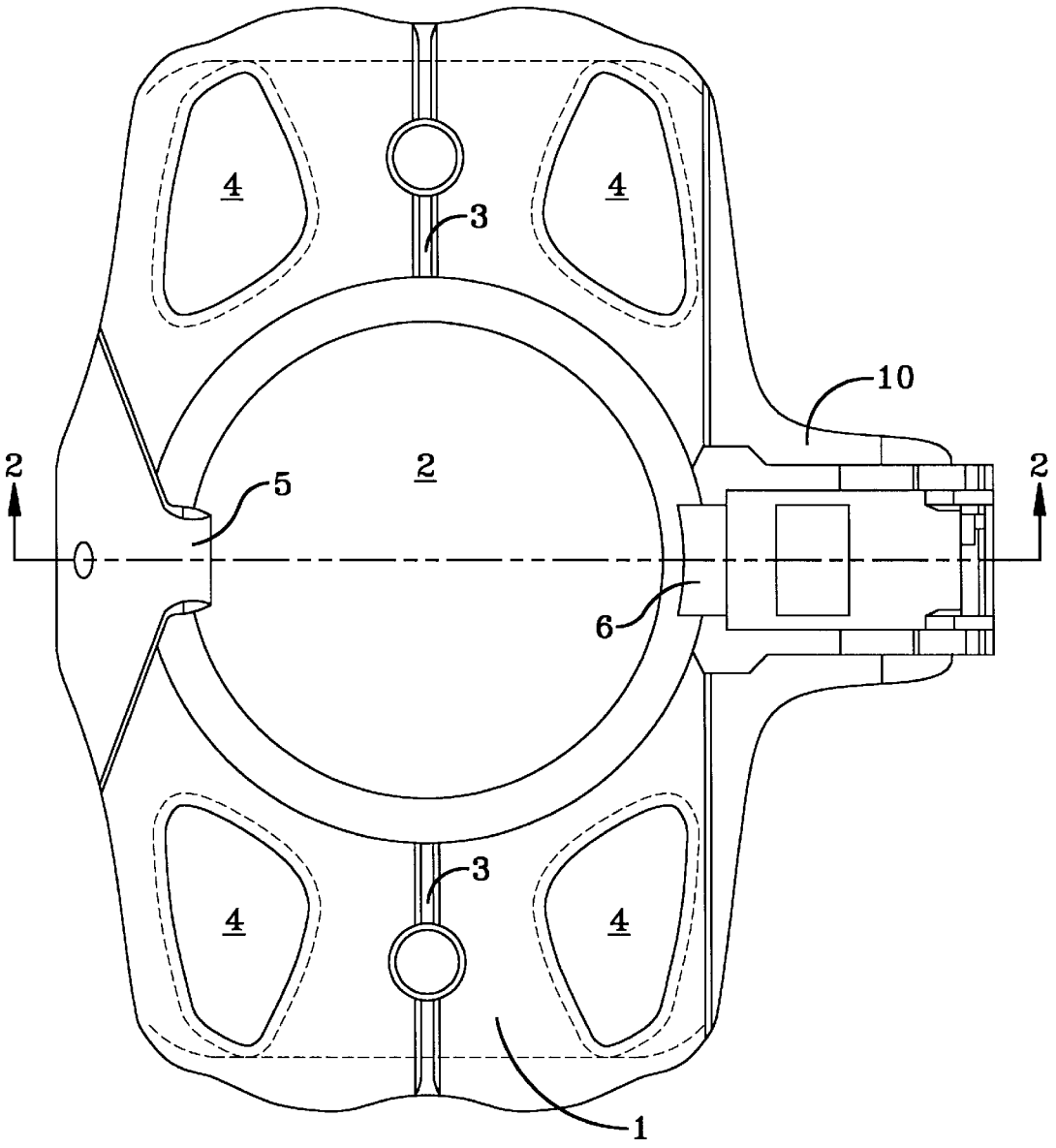
FIG. 1 is a schematic plan view of a binding according to a preferred embodiment of the invention.

Referring now to the drawings wherein the showings are for the purpose of illustrating preferred embodiments of the invention only, and not for the purpose of limiting same, FIG. 1 shows a binding according to a first embodiment of the present invention. The binding includes a standing plate 1 for the purpose of receiving a snowboard boot (not shown), and can be fastened on the upper side of a snowboard or the like. Standing plate 1 has a large central circular opening 2 which can be covered over by means of a flange plate (not shown) which overlaps the borders of circular opening 2 and can be screwed to the snowboard or the like. The flange plate holds standing plate 1 under stress against the upper side of the snowboard. As a result, standing plate 1 can be rotated relative to the snowboard and fixed at various angles relative to the longitudinal axis of the snowboard.

On standing plate 1 there may be arranged tongues or grooves 3 or other protrusions or recesses which interact with complementary grooves, tongues, recesses or protrusions on the underside of a boot sole, in order to secure the same in a positively locking manner. If appropriate, it is also possible for shaped pieces (not shown) or the like to be inserted into recesses 4. The shaped pieces support corresponding regions of the boot sole at a more or less large distance from the upper side of the snowboard or the like.

In order to secure the boot sole on standing plate 1, use is made of a stationary sole-retaining means 5 and a movable sole-retaining means 6 which, in the event of the snowboard boot being positioned on standing plate 1, can be pressed downward, in the manner described hereinbelow. In this respect, sole-retaining means 6 is movable from an open or self-holding "release" position to a closed or "clamped-in" position, where the sole of the boot is secured by sole-retaining means 5 and 6 on the two longitudinal borders thereof, approximately in the center region of the boot. Sole-retaining means 5 and 6 engage over the two longitudinal borders of the boot sole at the approximate center of the boot, with the result that the boot can be introduced into the binding in both a forwards direction and in a rearwards direction.

It should be appreciated that the term "closed position" refers to both an intermediate closed position as well as the fully closed position. The term "intermediate closed position" refers to a position of sole-retaining means wherein the boot sole is secured to the binding, but the sole-retaining means is spaced apart from the fully closed position. An intermediate closed position can accommodate snow, ice or the like which may adhere to the underside of the boot sole and impede movement of the sole retaining means to the fully closed position.

Figure 2:
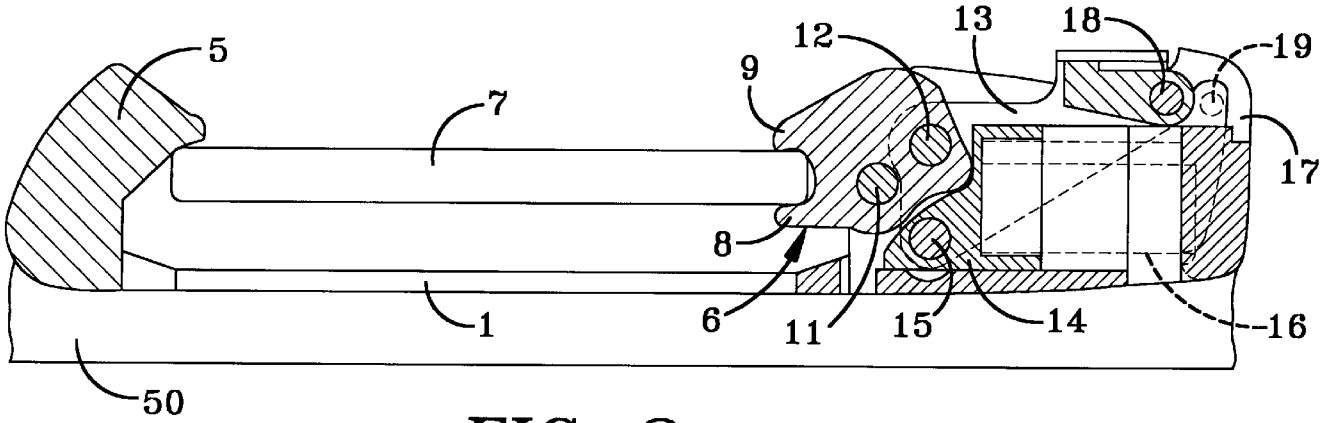
FIG. 2 is a sectional view along section line II—II in FIG. 1, the movable sole-retaining means assuming a fully closed position.
Figure 3:
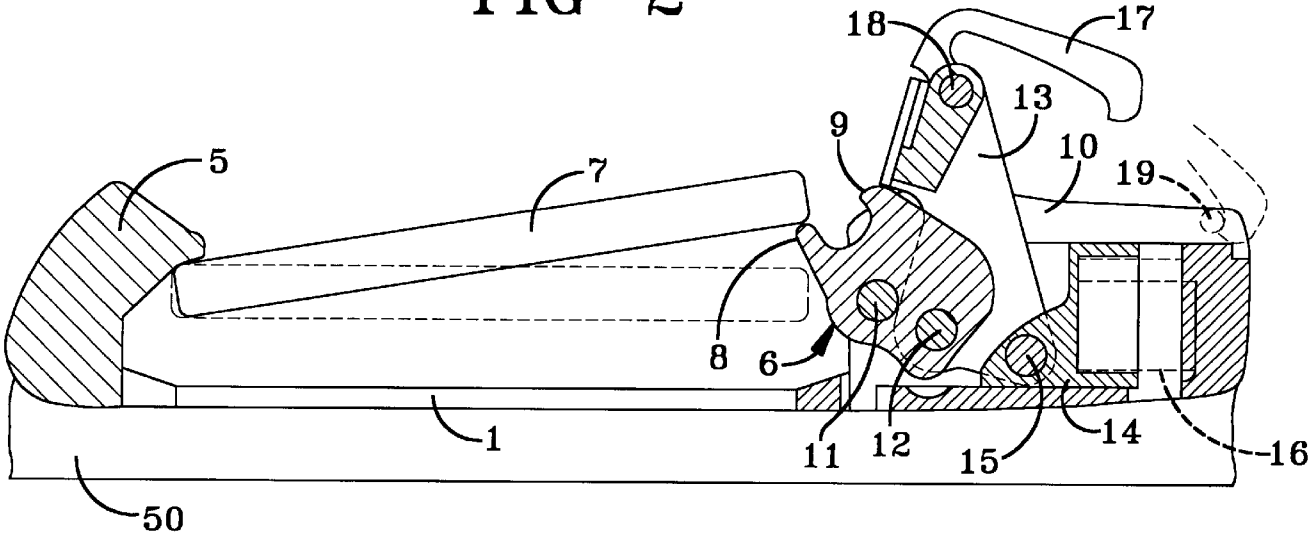
FIG. 3 is a sectional view which corresponds to FIG. 2 and illustrates the open position of the sole-retaining means.

Reference is now made to FIGS. 2 and 3, which respectively illustrate sole-retaining means 6 in the fully closed position and in the open position. Sole-retaining means 6 has a tread spur 8, which engages with the lower surface of boot sole 7 of the snowboard boot in the closed position, and a protrusion 9, which engages with the upper surface of the sole 7 in the closed position.

Sole-retaining means 6 is designed kinematically as a double-armed lever which is mounted pivotably on a housing 10 by way of a stationary bearing pin 11. Bearing pin 11 is aligned approximately parallel to the upper side of the snowboard 50 and to the longitudinal axis of sole 7. The first lever arm is formed by tread spur 8 and protrusion 9. The second lever arm of sole-retaining means 6 projects into housing 10.

Within housing 10, sole-retaining means 6 is connected to a lever 13, on the side of bearing pin 11 which is located opposite tread spur 8 and protrusion 9. Sole-retaining means 6 is connected to lever 13 via a joint with a joint pin 12 which is parallel to bearing pin 11. Lever 13 is mounted pivotably on a slide 14 by means of a pivot pin 15 which is parallel to joint pin 12. Slide 14 is moved under stress in the direction of sole-retaining means 6 by a spring mechanism 16, formed for example by helical springs. Spring mechanism 16 is supported in a stationary manner on a portion of housing 10 on that side of slide 14 which is remote from sole-retaining means 6, and is secured displaceably in housing 10 in guide tracks (not shown in detail).

In the open or "release" position, sole-retaining means 6 is located in a self-holding over-dead-center position shown in FIG. 3. In this position, sole-retaining means 6 is held in the open position. In this respect, joint pin 12 is located vertically beneath a plane containing the axes of bearing pin 11 and of pivot pin 15, and is biased in the downwards direction by the force of spring mechanism 16. Joint pin 12 forces sole-retaining means 6 against an underside of housing 10 by means of a lug located beneath joint pin 12.

In the event of a boot being introduced into the binding, sole 7 is pushed beneath the protrusion provided therefor on stationary sole-retaining means 5, by means of one longitudinal border of sole 7, and is positioned on tread spur 8 of movable sole-retaining means 6 (FIG. 3) on the other longitudinal border of sole 7. If sole 7 of the boot is then pressed downward toward the upper surface of the snowboard or the like, sole-retaining means 6 will pivot towards the closed position shown in FIG. 2. In this respect, spring mechanism 16 moves sole-retaining means 6, under stress, into the closed position, as soon as joint pin 12 reaches a position above the plane containing the axes of bearing pin 11 and pivot pin 15. Accordingly, sole 7 may also be secured in a play-free manner in which the binding remains in the closed position even if the sole is moved to a limited extent, when there is a layer of snow or ice of limited thickness on the underside of sole 7. Therefore, the boot may be secured to the binding in an intermediate closed position, where sole-retaining means 6 is a distance from the fully closed position.

The fully closed position of sole-retaining means 6 is of a self-locking form, and thus, sole-retaining means 6 is securely held in the closed position. In this respect, a plane which contains the axes of bearing pin 11 and joint pin 12 and a plane which contains the axes of joint pin 12 and pivot pin 15, form an angle which is open downwards in the form of a V and is smaller than a right angle in the fully closed position (FIG. 2). Forces acting between sole 7 and sole-retaining means 6 in the direction of the open position of sole-retaining means 6 can cause virtually no reaction forces which could counter the force of spring mechanism 16 and thus displace slide 14 to the right from the fully closed position shown in FIG. 2.

Moreover, to ensure and to indicate non-disengageable securing of sole 7 when sole-retaining means 6 has not yet reached the fully closed position shown in FIG. 2, a pivot hook 17 is arranged at the free end of lever 13. Pivot hook 17 is mounted rotatably on a rod 18, arranged on lever 13. The longitudinal axis of rod 18 is parallel to the longitudinal axis of pivot pin 15 of lever 13. Pivot hook 17 is biased towards an end position in the clockwise direction relative to lever 13 by means of a spring (not shown). For this purpose, rod 18 may be designed in the form of a torsion rod.

When lever 13 is pivoted in the clockwise direction out of the position shown in FIG. 3 as sole 7 is pressed downward, pivot hook 17 engages resiliently behind a stub 19 arranged fixedly on housing 10. Accordingly, sole-retaining means 6 and lever 13, which then must both have reached a position in which they are near to the fully closed position shown in FIG. 2, are prevented from returning to the open position shown in FIG. 3. Rather, such a return is only possible if pivot hook 17 is pivoted manually in the anticlockwise direction relative to lever 13. It should be appreciated that pivot hook 17 may be pivoted by means of a ski pole or the like.

The foregoing arrangement makes it simple to visually check whether pivot hook 17 is engaged behind stub 19. Accordingly, when a boot is introduced into the binding with a layer of snow or ice on the underside of sole 7 and thus sole-retaining means 6 cannot initially be pressed downward into its fully closed position, a visual check can readily be made as to whether a closed position, which is secured against undesired disengagement (or opening to the release position), has been reached. This applies irrespective of the magnitude of stressing of spring mechanism 16 and of whether, in the event of a boot being introduced into the binding, sole-retaining means 6 can be pressed downward into an over-dead-center position with respect to spring mechanism 16 or not.

Figure 4:
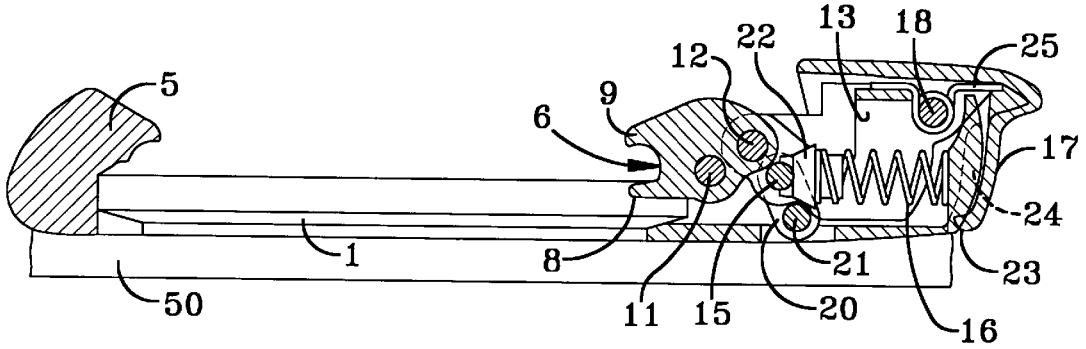
FIG. 4 is a sectional view of a binding according to a modified embodiment of the present invention in the fully closed position.
Figure 5:
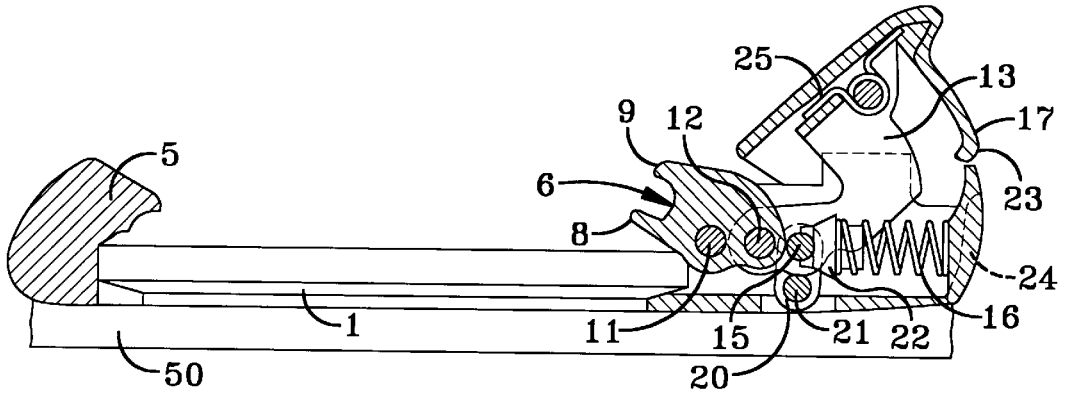
FIG. 5 is a sectional view of the modified embodiment in the open position.
Figure 6:
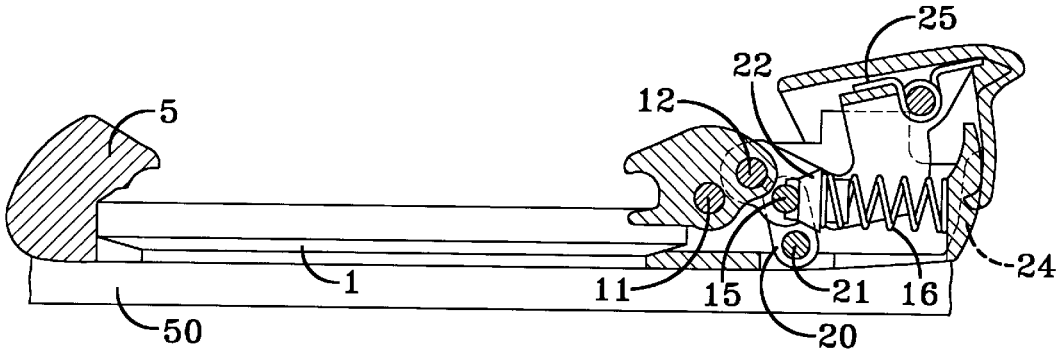
FIG. 6 is a sectional view of the modified embodiment in an intermediate closed position.

The embodiment of the present invention shown in FIGS. 4–6 differs from the embodiment shown in FIGS. 2 and 3 in several respects. First, pivot pin 15 of lever 13 is arranged on a rocker lever 20, which is mounted on housing 10 such that it can be tilted about a stationary rocker pin 21 extending parallel to pivot pin 15.

Spring mechanism 16 is held under stress against a movable abutment 22 arranged on pivot pin 15. As a result, spring mechanism 16 attempts to displace pivot pin 15 in the direction of sole-retaining means 6 in principally the same manner as the embodiment shown in FIGS. 2 and 3. This results in largely the same kinematic relationships as for the embodiment shown in FIGS. 2 and 3.

The arrangement of the embodiment shown in FIGS. 4–6 is advantageous insofar as the securing of lever 13 on rocker lever 20 remains smooth in operation even if contaminated with dirt, while a comparatively small number of parts have to be assembled for an arrangement according to the embodiment shown in FIGS. 2 and 3.

In the embodiment shown in FIGS. 4–6, pivot book 17 forms a pivotable grip piece having book-shaped protrusions 23 which resiliently engages surfaces defining recesses 24 formed in the housing, Pivot hook 17 engages the surfaces defining recesses 24 as soon as sole-retaining means 6 and lever 13 have been pivoted out of the open position shown in FIG. 5 into an intermediate closed position shown in FIG. 6 or into the fully closed position shown in FIG. 4. As a result, returning again to the open position shown in FIG. 5 is only possible when the grip piece on pivot book 17 is pivoted deliberately or manually in the anticlockwise direction relative to lever 13, counter to the force of a leg spring 25.

Figure 7:
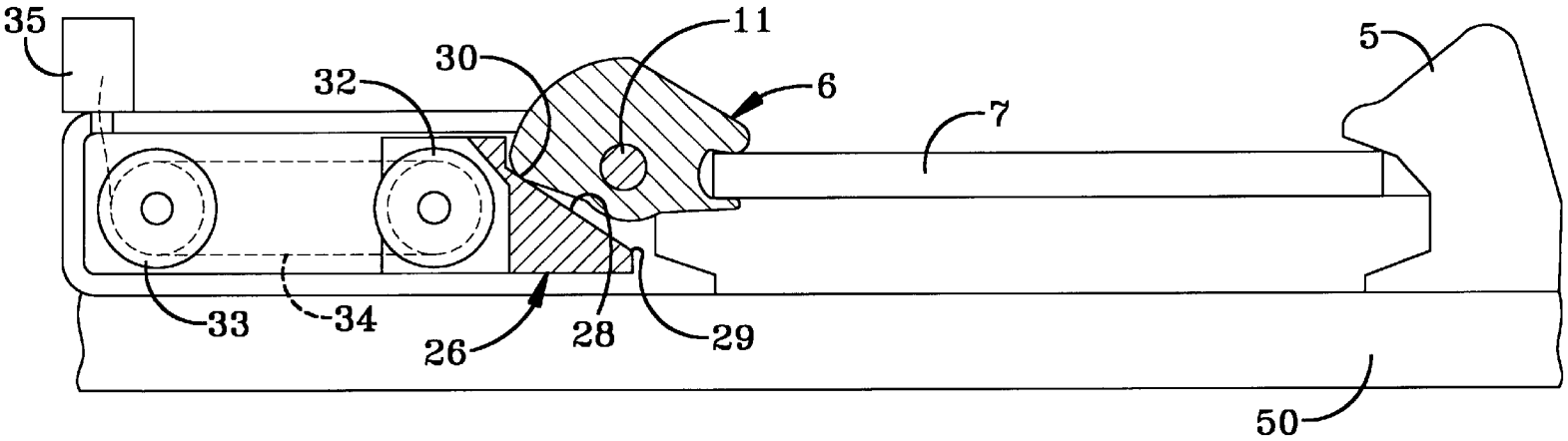
FIG. 7 is a sectional view of a binding according to a further embodiment of the present invention in the open position.
Figure 8:
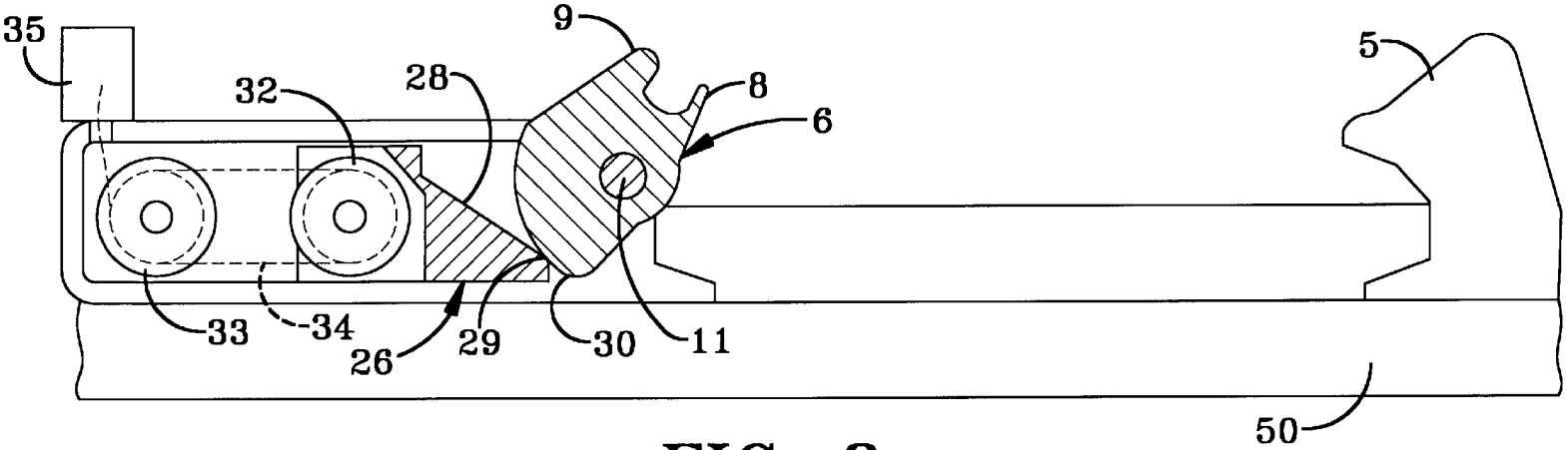
FIG. 8 is a sectional view of a binding according to the further embodiment in the fully closed position.
Figure 9:
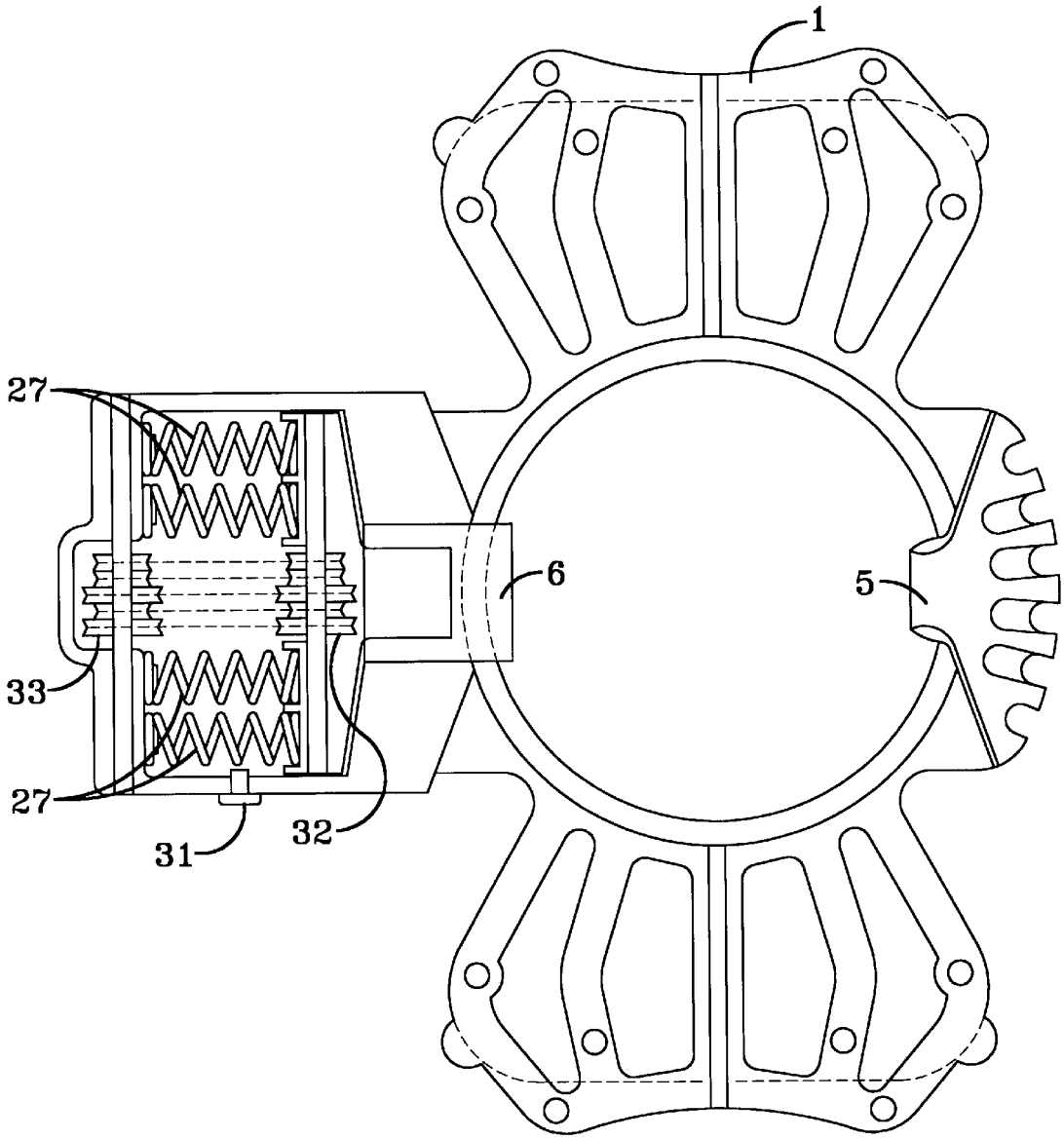
FIG. 9 is a top plan view, which is partially cut open, of the further embodiment shown in FIGS. 7 and 8.

Turning now to the embodiment shown in FIGS. 7–9, movable sole-retaining means 6 interacts directly with a slide 26, which is forced to the right in FIGS. 7–9 by a plurality of helical compression springs 27 (FIG. 9) arranged in parallel. The side of slide 26 facing sole-retaining means 6 has a sloping surface 28, which passes into a relatively steep stop surface 29 at the lower end thereof.

Movable sole-retaining means 6, which is biased in the anticlockwise direction by a restoring spring (not shown), has a cam 30 on the side facing slide 26. In the open position of sole-retaining means 6 (FIG. 8), cam 30 interacts with stop surface 29 by means of a gently curved region whose center of curvature coincides with the axis of bearing pin 11 of sole-retaining means 6. Accordingly, sole-retaining means 6 assumes and holds the position shown in FIG. 8, and slide 26 is prevented from being displaced to the right.

In the event of a boot being introduced into the binding, sole-retaining means 6 is pressed downward in the direction of the fully closed position shown in FIG. 7. In this respect, when the boot sole is placed on tread spur 8, cam 30 slides, by means of a region with pronounced curvature, onto the sloping surface 28. As a result, springs 27 can displace slide 26 to the right. In the process, sole-retaining means 6 is pivoted in the clockwise direction.

As soon as slide 26 has moved to a sufficient extent to the right, away from the open position shown in FIG. 8, arresting pins 31 can be pushed into housing 10 (FIG. 9). When pins 31 are in the pushed-in position, they prevent slide 26 from returning to the open position. Consequently, sole-retaining means 6 is not able to move to the open position shown in FIG. 8.

A cable pull with slide-side rollers 32 and housing-side rollers 33 is provided in order to be able to move slide 26 into the open position shown in FIG. 8 when the arresting pins 31 have been drawn out. One end of a cable 34, which is guided over rollers 32 and 33 in the manner of a block and tackle, is fastened on slide 26 or on housing 10. The other end of cable 34 is fastened on a grip piece 35. Grip piece 35 is drawn in the upwards direction to displace slide 26 to the left in FIGS. 7–9. If grip piece 35 is released, excess cable 34 is wound up by a spring-loaded reel (not shown) accommodated in the grip piece 35. Accordingly, slack cable is avoided. The springs which actuate the reel are of such small dimensions that springs 27 can displace slide 26 to the right with a relatively large amount of force when grip piece 35 is released.

Figure 10:
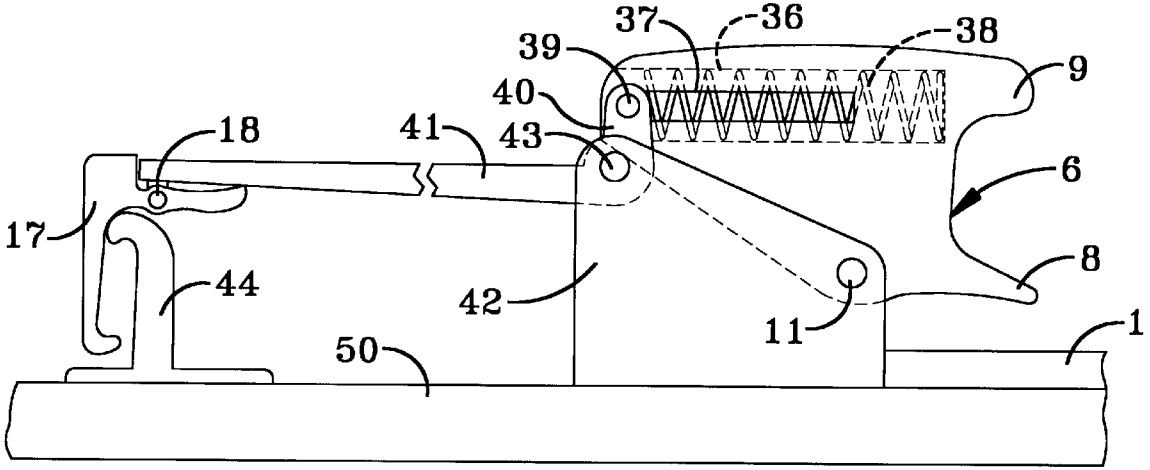
FIG. 10 is a plan view of a binding according to yet another embodiment.
Figure 11:
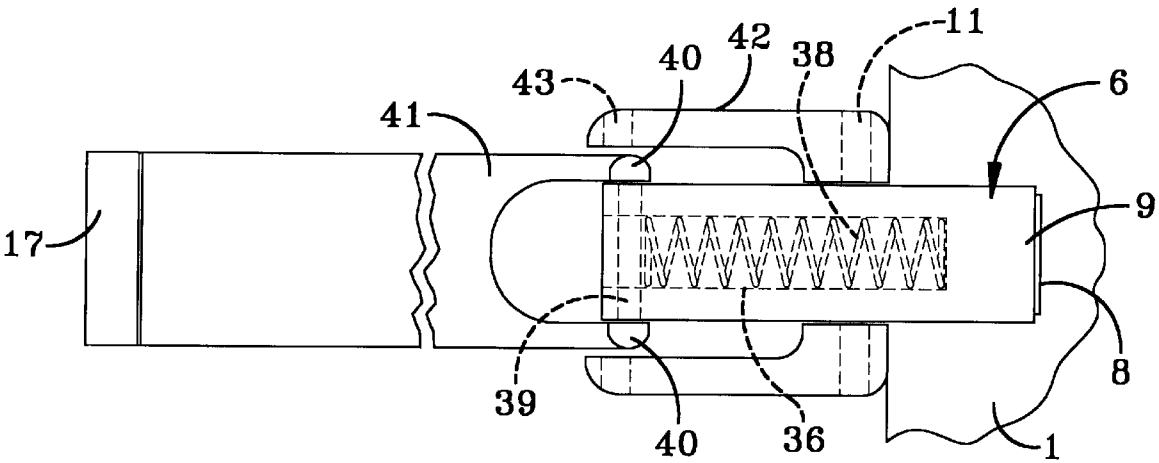
FIG. 11 is a top plan view of the embodiment shown in FIG. 10.

In the embodiment shown in FIGS. 10 and 11, movable sole-retaining means 6 is once again arranged on the snowboard 50 such that it can be pivoted about its bearing pin 11. Moreover, sole-retaining means 6 is also designed in the manner of a double-armed lever, one lever arm having tread spur 8 and protrusion 9 and the other lever arm having, in extension of said protrusion 9, a bore 36 with lateral axial slots 37. Arranged within bore 36 is a helical compression spring 38 or the like which forces a pin 39 to the left as shown in FIG. 10. Pin 39 can be displaced sidewards in the axial slots 37.

Pin 39 is secured on arms 40 on both sides of sole-retaining means 6. Arms 40 are designed as parts of an angle lever 41 which is mounted pivotably on stationary bearing blocks 42, on those sides of arms 40 which are remote from sole-retaining means 6. For this purpose, angle lever 41 may be inserted into corresponding bearing eyelets of bearing blocks 42 by means of bearing journals 43 arranged on angle lever 41.

At the free end of angle lever 41, which is at a distance from the arms 40, angle lever 41 has a pivot hook 17 which is arranged rotatably on angle lever 41 by means of a rod 18. A spring mechanism (not shown in detail) moves pivot hook 17 under stress, in the anticlockwise direction relative to angle lever 41, as shown in FIG. 10. Accordingly, pivot hook 17 is moved to the end position represented in FIG. 10. It should be appreciated that rod 18 may once again be designed as a torsion rod for this purpose.

Pivot hook 17 interacts with a stationary hook 44 which is arranged on the snowboard. Pivot hook 17 engages behind stationary hook 44 as soon as angle lever 41 reaches a position in which it is near to the end position, as represented in FIG. 10.

If angle lever 41 is to be pivoted manually in the clockwise direction out of the fully closed position shown in FIG. 10, pivot hook 17 will likewise need to be pivoted manually relative to angle lever 41, in order to move pivot book 17 out of engagement with stationary hook 44. Pivoting angle lever 41 in the clockwise direction means that sole-retaining means 6 is pivoted up into its open position, which forms an over-dead-center position with respect to spring 38. In this respect, pin 39 reaches a position beneath a plane which contains the axes of bearing pin 11 and of bearing journal 43.

In the event of a boot being introduced into the binding, the boot sole presses tread spur 8 downward. As a result, sole-retaining means 6 pivots into the closed position shown in FIG. 10. By interaction of pivot hook 17 with stationary book 44, angle lever 41 is prevented from returning to its position corresponding to the open position of sole-retaining means 6, even before sole-retaining means 6 reaches its fully closed position, in which it rests on the snowboard and which can form an over-dead-center position.

Each of the foregoing embodiments discussed above are designed such that, in the closed or "clamped-in" position of movable sole-retaining means 6, there are only flat binding parts on either side of sole 7 or of the boot. Moreover, these flat binding parts are designed or arranged such that, when forced in the downwards direction, they cannot move sole-retaining means 6 into its open or "release" position. This is particularly important when a snowboarder is traveling on a drag lift and only has one foot clamped in the associated binding, while the other foot remains free for getting on and off the lift and could thus, inadvertently, be placed, from above, on a binding part of the binding of the clamped-in foot.

The foregoing description is specific embodiments of the present invention. It should be appreciated that these embodiments are described for purposes of illustration only, and that numerous alterations and modifications may be practiced by those skilled in the art without departing from the spirit and scope of the invention. For instance, elements 17 and 31 could be replaced with any unlockable locking elements which, once a closed or "clamped-in" position of sole-retaining means 6 has been reached, prevent the undesired return of sole-retaining means 6 into the open or "release" position and/or permit sole-retaining means 6 to move only in the direction of its fully closed or clamped-in "end" position. Moreover, arresting pins 31 (FIG. 9) may also be dispensed with. In this respect, springs 27 in FIG. 9 may readily be made to be very strong and the gradient of sloping surface 28 may be sufficiently small. As a result, the forces occurring between boot sole 7 and sole-retaining means 6 during snowboarding cannot at any time result in disengagement of sole-retaining means 6. Moreover, disengagement due to strong spring forces and/or self-locking between sole-retaining means 6 and sloping surface 28 is prevented. It is also possible for strong spring forces to be overcome with low exertion of force by means of the cable pull.

It is intended that all such modifications and alterations be included insofar as they come within the scope of the invention as claimed or the equivalents thereof.

The invention claimed is:

1. A binding for releasably attaching a boot having a sole to a snowboard comprising:

stationary sole-retaining means adapted to grip a first longitudinal side of the boot sole;

movable sole-retaining means adapted to grip a second longitudinal side of the boot sole and movable between an open position and a plurality of closed positions, said plurality of closed positions including at least one intermediate closed position and a fully closed position for attaching the boot sole at predetermined raised and lowered positions respectively relative to an upper surface of the snowboard;

manually-operable lever means operatively connected to said movable sole-retaining means and movable between at least first and second engaged positions for moving said movable sole-retaining means between at least one of the intermediate and fully closed positions respectively, and a disengaged position for moving said movable sole-retaining means to the open position;

spring means for biasing said movable sole-retaining means toward the fully closed position when said movable sole-retaining means is in the at least one intermediate closed position; and locking means attached to said lever means, said locking means being movable between at least first and second locked positions for locking said movable sole-retaining means in the at least one intermediate and fully closed positions respectively, and an unlocked position for permitting said movable sole-retaining means to move to the open position.

2. A binding according to claim 1, wherein said locking means automatically moves to the second locked position when said sole-retaining means is moved to the closed position.

3. A binding according to claim 1, wherein said locking means includes an external surface which permits the position of said locking means to be visually observable.

4. A binding according to claim 1, wherein said locking means moves said lever means between at least one of said engaged positions and said open position.

5. A binding according to claim 1, wherein said binding further comprises a stationary bearing means, said sole-retaining means arranged on said stationary bearing means by a first bearing pin.

6. A binding according to claim 5, wherein said binding further comprises a pivotable bearing means, said lever means arranged on said pivotable bearing means by a Divot pin, wherein said pivotable bearing means is movable in a direction parallel to the upper side of said snowboard and transverse to the longitudinal axis of the pivot pin.

7. A binding according to claim 6, wherein said lever means is articulated on said sole-retaining means by a joint pin.

8. A binding according to claim 7, wherein said spring means moves said pivotable bearing means, under stress, in the direction of said joint pin.

9. A binding according to claim 1, wherein said binding further comprises slide means biased by said spring means, said lever means mounted pivotably on said slide means.

10. A binding according to claim 1, wherein said binding further comprises a rocking lever means, said lever means mounted to said rocking lever means such that said lever means can be moved generally parallel to the upper side of said snowboard.

11. A binding according to claim 1, wherein said stationary sole-retaining means and said movable sole-retaining means grip said boot sole along a central region thereof.

12. A binding according to claim 1, wherein said binding further comprises a slide member having a sloping surface and biased by spring means, and said movable sole-retaining means having a cain member, said sloping surface engageable with said cam member to move said movable sole-retaining means, under stress, in the direction of the fully closed position.

13. A binding according to claim 12, wherein said binding further comprises a cable pull member for adjusting said slide member counter to the force of said spring means.

14. A binding according to claim 1, wherein said binding further comprises an angle lever means having a pin arranged thereon to be displaceable in a slot in the movable sole-retaining means in a sidewards direction transverse to the direction of a pivot pin of the sole-retaining means, said pin being forced away from said pivot pin by means of a spring means arranged on said movable sole-retaining means.

* * * * *